US005125687A

United States Patent [19]

Hwang

[11] Patent Number: 5,125,687

[45] Date of Patent: Jun. 30, 1992

[54] ROLLERBOARD FOR ROAD-SKIING

[76] Inventor: Sun-ik Hwang, 563, Shinlim 8-dong, Kwanak-ku, Seoul, Rep. of Korea

[21] Appl. No.: 661,672

[22] Filed: Feb. 27, 1991

[51] Int. Cl.[5] ..... A63C 17/06

[52] U.S. Cl. ..... 280/842; 188/5; 188/217; 280/11.2; 280/87.042

[58] Field of Search ..... 188/5, 217; 280/842, 280/11.2, 87.01, 87.021, 87.041, 87.042, 7.14, 8, 14.3

[56] References Cited

U.S. PATENT DOCUMENTS

| | | | |
|---|---|---|---|
| 1,056,357 | 3/1913 | Murdock | 280/87.042 |
| 1,327,123 | 1/1920 | Thomas | 280/87.021 |
| 1,620,939 | 3/1927 | Behm | 280/87.021 X |
| 1,706,048 | 3/1929 | Van De Mark | 280/14.2 X |
| 1,810,380 | 6/1931 | Van Etten | 280/11.2 |
| 3,151,876 | 10/1964 | Hahto | 280/14.3 |
| 3,885,803 | 5/1975 | Christian | 280/8 |
| 4,289,325 | 9/1981 | Whitacre | 280/87.042 |
| 4,460,187 | 7/1984 | Shimizu | 280/11.2 X |
| 4,521,029 | 6/1985 | Mayes | 280/7.14 |
| 4,807,893 | 2/1989 | Huang | 280/11.2 |
| 4,865,342 | 9/1989 | Kong | 280/87.042 |

FOREIGN PATENT DOCUMENTS

| | | | |
|---|---|---|---|
| 2435958 | 5/1980 | France | 280/87.042 |
| 86-915 | 5/1986 | Rep. of Korea . | |

*Primary Examiner*—Andres Kashnikow
*Assistant Examiner*—Michael Mar
*Attorney, Agent, or Firm*—Morgan & Finnegan

[57] ABSTRACT

There is provided a rollerboard for road-skiing using a pair of poles and having a board body with two footholds on the both sides of the longitudinal axis thereof. A front roller assembly and a rear roller assembly is supported by and disposed under the board body. The front roller is horizontally journaled by a front roller bracket vertically pivoted on a plate secured on the board body with a horizontal distance between the shaft of the front roller and the pivot of the front rollerbracket, and the rear roller assembly includes a rear roller journaled by a rear rollerbracket mounted on the board body under the region of the footholds. In addition, a brake means is provided including at least a brake shoe bracket, whose one end is hingedly mounted at the rear end region of said board body and the other end is secured with a brake shoe facing the ground, and at least a spring means interposed between each said shoe bracket and said board body respectively to provide braking tolerance.

5 Claims, 5 Drawing Sheets

ROLLERBOARD FOR ROAD-SKIING

BACKGROUND OF THE INVENTION

1. Field of the Invention

This invention relates to a roller ski for roadskiing, more particularly to a roller ski with which a rider can enjoy riding with both feet thereon using a pair of poles on even roads, as if he were skiing on the snow.

2. Description of the Related Art

Rollerskates, skateboards, roller skis and the like, as means for riding on even lands such as road, have been widely known and used for a long time. However, because these are derived, controlled and balanced by actions of rider's body and legs, high speeds and intricate maneuvers are attainable only by highly skillful riders and it is difficult for a novice to attain proficiency therein.

SUMMARY OF THE INVENTION

Accordingly, an object of this invention is to provide a new type of roller ski for road-skiing using a pair of poles to provide easy and safe riding and exciting feelings from high speeds and intricate maneuvers even to a novice.

Another object of the invention is to provide a roller ski applicable to a sledgeboard on the ice or a skiboard on the snow or on the lawn.

According to the invention, there is provided a roller ski comprising: a board body having two footholds on the both sides of the longitudinal axis thereof; a front roller assembly and a rear roller assembly supported by and disposed under the board body, the front roller assembly including a front roller horizontally journaled by a front roller bracket vertically pivoted on a mounting plate secured on the board body with a horizontal distance between the shaft of the front roller and the pivot of the front rollerbracket, and the rear roller assembly including a rear roller journaled by a rear rollerbracket mounted on the board body under the region of the footholds; and a brake means including at least a brake shoe bracket whose one end is hingedly mounted at the rear end region of the board body and the other end is secured with a brake shoe facing the ground, and at least a spring means interposed between each shoe bracket and the board body.

According to an embodiment of the invention, the rear roller assembly is provided with at least a shock absorber means between the rear rollerbracket and the board body.

According to another embodiment of the invention, there is provided a roller ski wherein under the board body, a pair of skateblades or a single skateblade or a skiplate is fixedly mountable. This allows the roller ski to be applied as a sledgeboard or a skiboard.

BRIEF DESCRIPTION OF THE DRAWINGS

Further objects and advantages of the invention can be more fully understood from the following detailed description taken in conjunction with the accompanying drawings in which:

FIG. 6A showing one of a pair of skateblades, FIG. 6B showing a single skateblade and FIG. 6C showing a skiplate;

DESCRIPTION OF THE PREFERRED EMBODIMENTS

Figure 1:
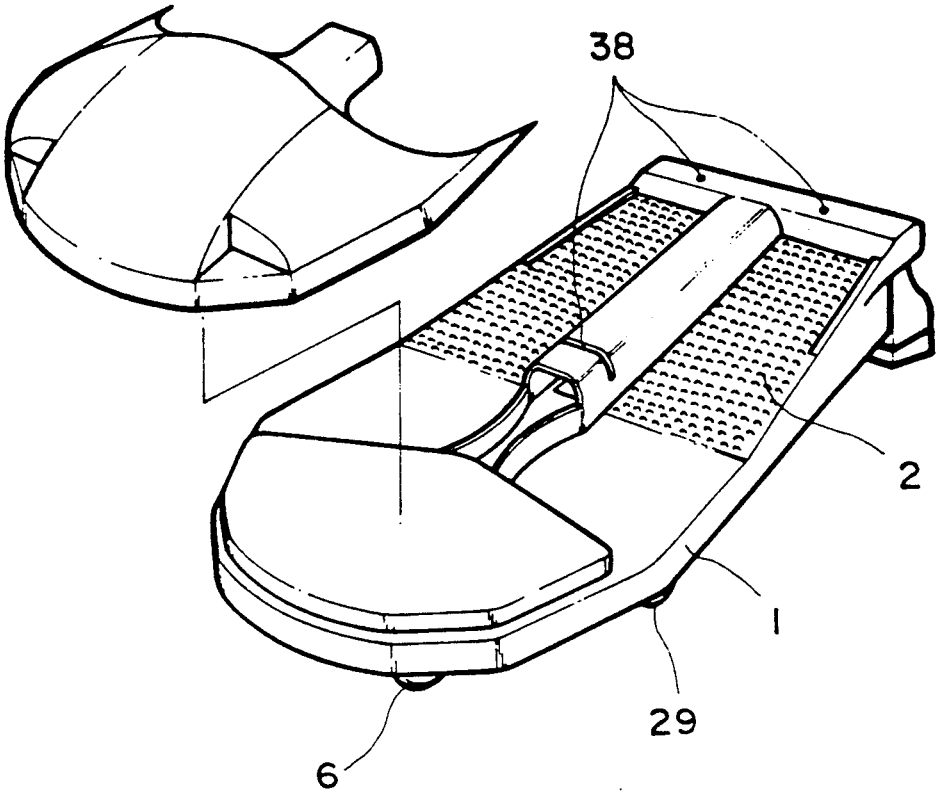
FIG. 1 is a perspective view showing a roller ski according to this invention.
Figure 2:
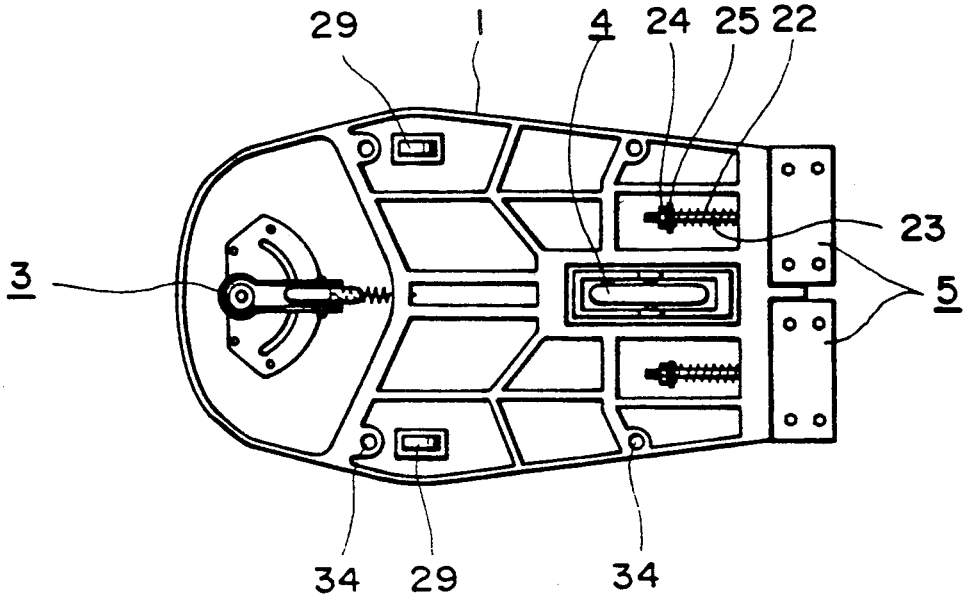
FIG. 2 is a bottom view of the roller ski.

As shown in FIG. 1 and 2, a roller ski has a board body 1, which may be modelled in general like a sports car or an airplane to exhibit reduced air resistance and good appearance. Board body 1 has two footholds 2 formed thereon as a part of the board body 1 or adhered thereon as separated parts. The footholds 2 are provided with numerous projections to improve friction with rider's feet. Under the board body 1, a front roller assembly 3 and a rear roller assembly 4 are disposed on the longitudinal axis of the board body 1. Moreover, brake means 5 is disposed on the rear end region of the board body 1.

Figure 3:
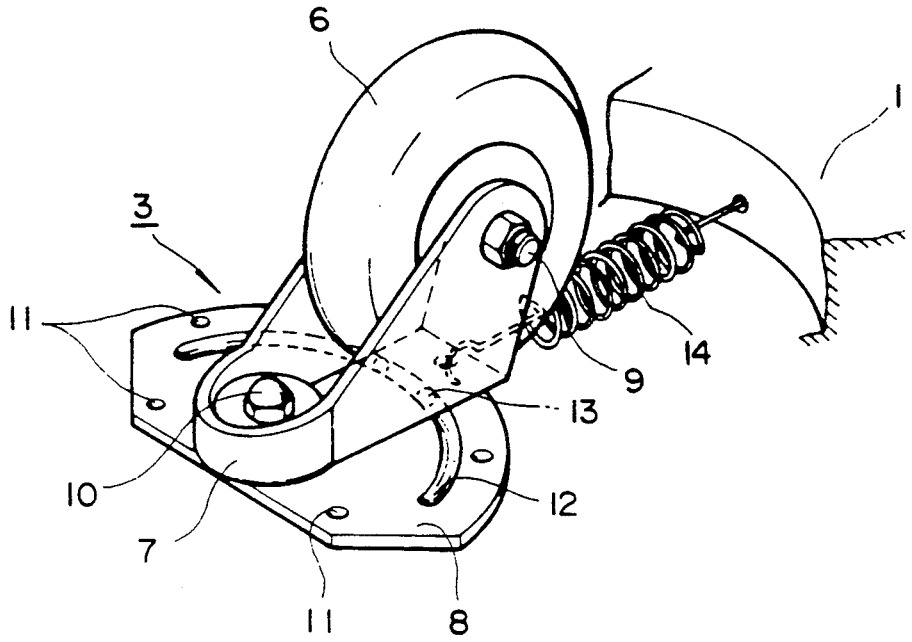
FIG. 3 is an enlarged perspective view of a front roller assembly.

The front roller assembly 3 has a front rollerbracket 7 which is vertically pivoted on a mounting plate 8 as shown in FIG. 3. The mounting plate 8 is fixedly mounted on the board body 1 by a plurality of holes 11 and screws. A front roller 6 is horizontally journaled through a roller shaft 9 by the front rollerbracket 7 with a horizontal distance between the contact point of the front roller 6 on the ground and the pivot 10 of the front rollerbracket 7. Thus, the front rollerbracket 7 can rotate on the pivot 10 within an angle with respect to the longitudinal axis of the board body 1 to allow the front roller 6 to change its rolling direction. Therefore, while travelling, the rider can voluntarily change his course by shoving the ground using his poles or by moving the gravity center of his body toward the desired direction.

Preferably, between the mounting plate 8 and the front rollerbracket 7, a bearing means is provided comprising a groove 12 formed in a circular arc on the mounting plate 8 and at least a ball 13 which is seated in a recess formed on the front rollerbracket 7 to interact with the groove 12. The bearing means guarantees the smooth rotation of the front rollerbracket 7 round on the pivot 10, while it receives the load on the front roller 6 to reduce or eliminate the bending moment on the front rollerbracket 7 and the pivot 10 due to the load. Moreover, a tension spring 14 is preferably interposed between the front rollerbracket 7 and a point of the board body 1 on the longitudinal axis thereof, so that the rolling direction of the front roller 6 always corresponds with the longitudinal axis of the board body 1. Accordingly, the front roller 6 always holds the rolling direction in alignment with the straight advancing direction of the board body 1, and quickly returns after change of the advancing direction by the rider.

Figure 4:
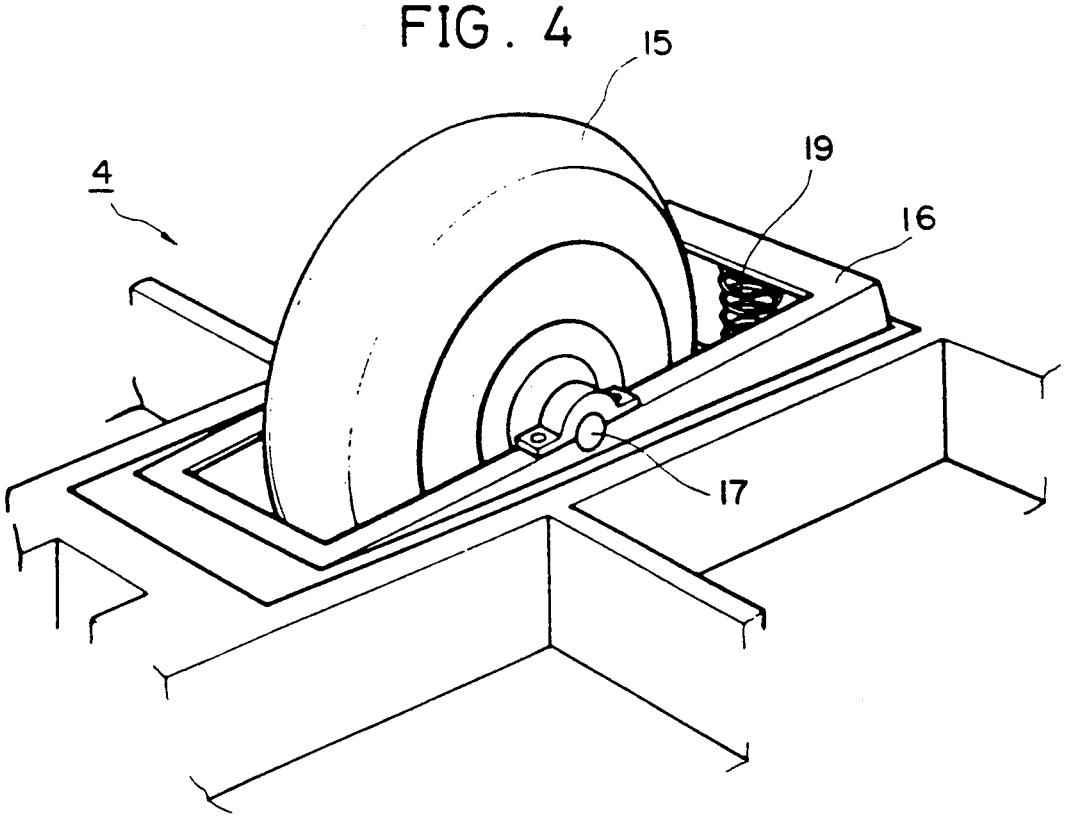
FIG. 4 is an enlarged perspective view of a rear roller assembly mounted on the board body.

As shown in FIGS. 2 and 4, the rear roller assembly 4 has a rear rollerbracket 16 mounted on the board body 1 by means of suitable fixing means, and a rear roller 15 is horizontally journaled by the rear rollerbracket 16. Here the longitudinal location of the rear roller shaft 17 lies under the region of the footholds 2. Thereby when the rider intends to brake the roller ski during travelling, he can put his gravity on heels to allow the board body 1 to turn over rearwards, so that a brake means to be mentioned later, which is mounted on the rear end portion of the board body 1, is brought into frictional contact with the ground to brake the roller ski.

In order to damp possible shocks upon rider due to road unevenness, in an embodiment of the invention in connection with the rear roller assembly 4 as shown in FIG. 4, a shock absorber means, especially at least a compression spring 19 is preferably provided between the rear rollerbracket 16 and the board body 1. To this end, advantageously, the front end of the rear rollerbracket 16 is hingedly mounted on the board body 1, and the compression spring 19 is interposed between the rear end of the rear rollerbracket 16 and the board body 1.

Figure 5:
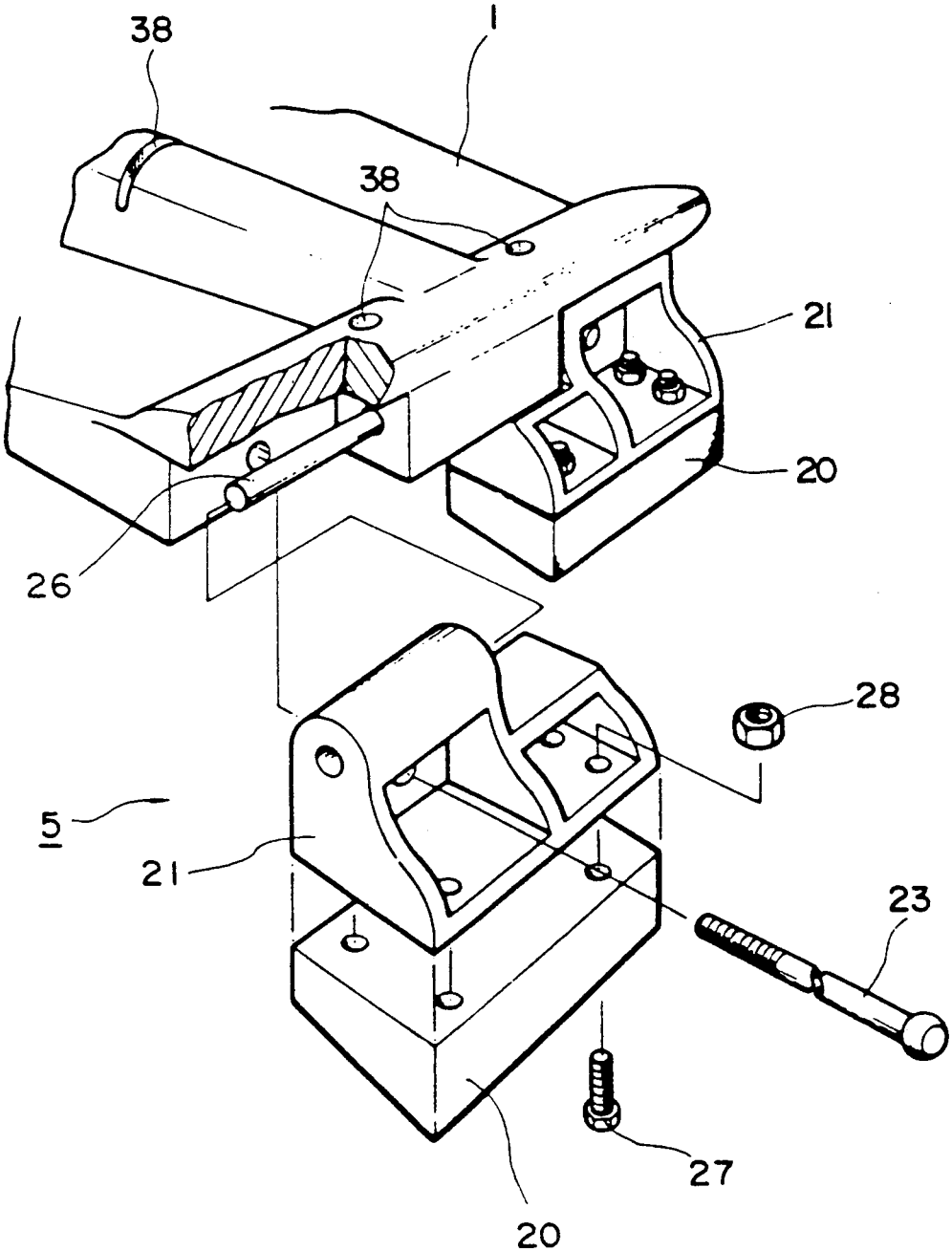
FIG. 5 is a perspective view showing a mounting example of the brake means according to the invention, partially taken to pieces.

In addition, in the rear end region of the board body 1, a brake means 5 is provided including at least a brake shoe bracket 21, as shown in FIG. 5 as an example, whose one end is hingedly mounted at the rear end region of the board body 1 and the other end is secured with the brake shoe 20, and a spring 22 is interposed between each shoe bracket 21 and the board body 1, respectively, so that in the time of braking it allows the brake means 5 to elastically move longitudinally or vertically to some extent. This brake means 5 is brought into frictional contact with the ground when the rider puts his weight on his heels, as stated above, to brake the roller ski during travelling. The brake shoe 20 is made of frictional materials having high friction coefficient on the ground and high stiffness, and it must be easily replaceable with a new one when it has been worn out.

According to the example illustrated in FIG. 5, the brake means 5 has two brake shoe brackets 21, which are hingedly mounted at hinge pins 26 disposed in the rear end region of the board body 1, and the brake shoes 20 are secured on each brake shoe bracket 21 by fasteners 27 and 28 facing the ground. A long bolt 23 passes longitudinally through the shoe bracket 21, the board body 1, the spring 22 and a washer 25 and is fastened by a nut 24 to compress the spring 22 to some extent. Accordingly, when the brake shoes become frictionally in contact with the ground, the shoe brackets 21 turn rearwards on the pivot pin 26 against the spring forces depending on the load on rider's heel. This makes the friction force of the brake shoes 20 on the ground strengthen by the aid of the elasticity of the spring 22 and allows the rider to control easily the braking force.

Alternatively, for the same purpose, apart from the example shown in FIG. 5, in which the shoe brackets 21 are vertically disposed and the springs 22 horizontally, it is also possible that brake shoe brackets be horizontally mounted by hinges disposed under the board body 1 and springs be vertically interposed between the shoe brackets and the board body 1, so that the shoe brackets can be elastically moved upward.

Moreover, according to an embodiment of this invention, a pair of subsidiary rollers 29 (FIG. 2) is further provided, disposed on the both sides under the board body 1 and rolling in the same direction as the front and rear roller 6 and 15. These prevent dangers of possible overturn of the roller ski and rider due to hitting of a side of the board body 1 against the ground during traveling, especially turning.

Figure 6A:
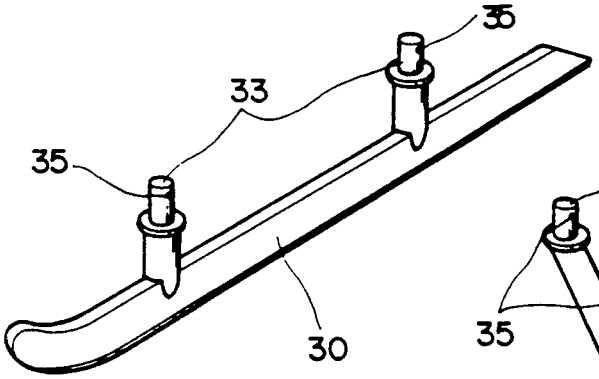
FIGS. 6A, 6B and 6C are perspective views of optional sliding means mountable under the board body according to embodiments of the invention.
Figure 6B:
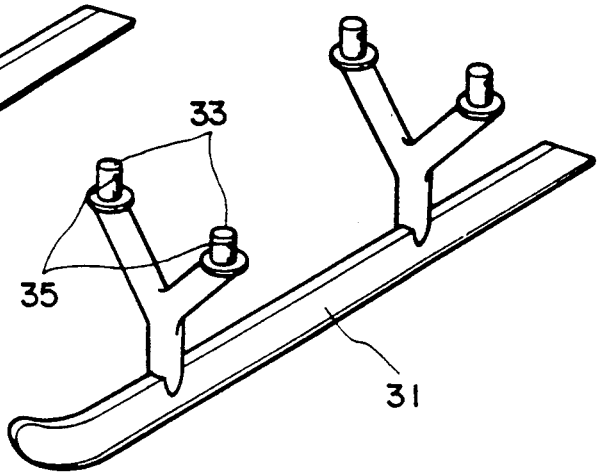
Figure 6C:
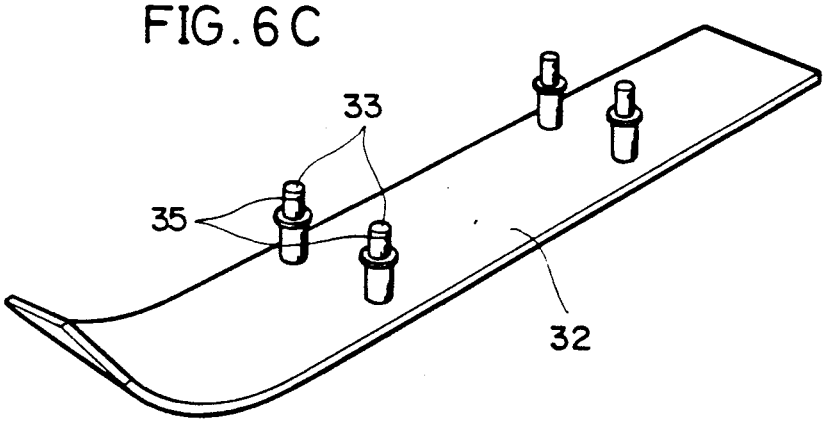

FIGS. 6A–6C show skateblades and a skiplate, which can be fixedly mounted under the board body 1 as sliding means on the ice, the snow or the lawn, according to an embodiment of this invention. FIG. 6A shows one of a pair of skateblades 30; FIG. 6B shows a single skateblade 31 and FIG. 6C shows a skiplate 32. On the ice, the roller ski is applicable to a double-bladed or single-bladed sledgeboard by using a pair of the skateblades 30 or the single skateblade 31, and on the snow or the lawn roller ski is applicable to a skiboard by using the skiplate 32. For mounting these on the board body 1, the board body 1 and the sliding means 30, 31 and 32 are provided with at least an interacting fixing means respectively. In the example shown in FIGS. 6, the sliding means 30, 31 and 32 have two or four inserts 33, being engaged in corresponding openings 34 (FIG. 2) formed in the bottom of the board body 1, and the fixing between the inserts 33 and the openings 34 is performed by lateral elastic projections 35 in the inserts 33 and corresponding recesses in the openings 34. However, the combination of engagement and fixing between the sliding means 30, 31 and 32 and the board body 1 is not limited to the shown example, but can be considered other various mechanisms, for example using hooks, pins, screws and the like.

Figure 7A:
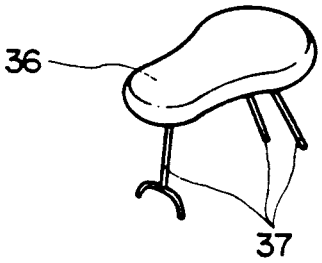
FIG. 7A is a perspective view showing a saddle assembly mountable on the board body according to an embodiment of the invention.
Figure 7B:
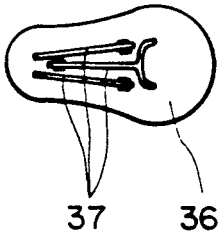
FIG. 7B is a bottom view of the saddle with folded legs.

FIG. 7A shows a saddle 36 mountable on the board body 1 according to an embodiment of this invention. This allows the rider to sit comfortably thereon during traveling. The saddle 36 has legs 37 which can be engaged in corresponding fixings 38 (FIG. 1) formed on the board body 1. As shown in FIG. 7B, the legs 37 can be folded to provide handy carrying along.

The roller ski according to the invention, having the construction as described above, can be enjoyed as shown in FIG. 8. On even lands such as roads, as shown in FIG. 8A, the rider can enjoy road-skiing with both feet thereon using a pair of poles, as if he were skiing on the snow. During riding, the rider can voluntarily change his course by shoving the ground using his poles or by moving the gravity center of this body toward desired direction. When the rider intends to brake the roller ski during traveling, he can put his gravity on heel so that the brake means 5 is brought in frictional contact with the ground to brake the rollerboard. The spring 22 according to the embodiment shown in FIG. 6 strengthens the friction force of the brake shoes 20 on the ground by the aid of the elasticity of the spring 22 and allows the rider to control the braking force easily.

The shock absorber means according to the embodiment shown in FIG. 4, especially at least a compression spring 19, which is provided between the rear rollerbracket 16 and the board body 1, can damp shocks on the rider due to road unevenness to provide comfortable riding. In addition, a pair of subsidiary rollers 29 disposed on both sides under the board body 1 can prevent possible overturn of the roller ski and rider due to hitting of a side of the board body 1 against the ground during turning.

Figure 8C:
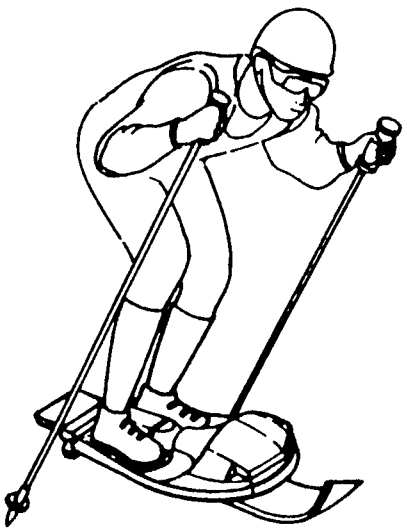
FIGS. 8A, 8B and 8C show different riding forms using the roller ski; on the road (FIG. 8A); on the ice with the skateblades and the saddle (FIG. 8B); and on the snow or the lawn with the skiplate (FIG. 8C).
Figure 8B:
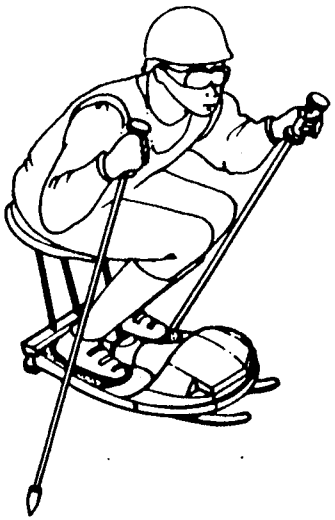
Figure 8A:
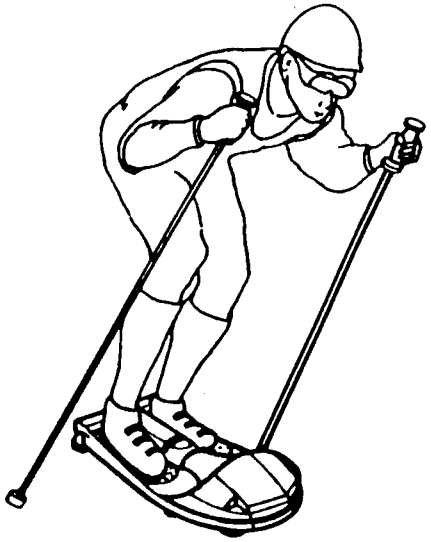

FIGS. 8 (B) and (C) show riding forms of the roller ski on the ice with the skateblade 30 and the saddle 36 and on the snow or the lawn with the skiplate 32. The rider can enjoy also riding with a pair of poles in the same manner as normal road riding.

As described above, the roller ski for roadskiing using a pair of poles provides easy and safe riding and exciting feelings from high speeds and intricate maneuvers, and can be used for training of sportsmen, especially skiers during the off-season. Moreover, the roller ski is applicable to a sledgeboard on the ice or a skiboard on the snow or the lawn to provide variety to riding.

What is claimed is:

1. A roller ski for road-skiing comprising:

a board body having a forward end, a rearward end and a foothold along each side of a central longitudinal axis of said board body;

a front roller assembly including a front roller journaled on a roller shaft of a front roller bracket pivotably mounted on a pivot of a mounting plate secured underneath said board body by a plurality of holes and screws with a horizontal distance between the roller shaft of said front roller and the pivot said mounting plate having a groove formed in a circular arc and at least a ball being seated in a recess formed on the front rollerbracket to interact with the groove;

a tension spring interposed between said front roller bracket and a point of the board body on the longitudinal axis thereof;

a rear roller assembly including a rear roller journaled by a rear rollerbracket hingedly mounted at its front end on said board body under the region of said footholds, said rear roller assembly further having a shock absorbing compression spring interposed between the rear end of the rear roller bracket and the board body; and a brake means including a pair of brake shoe brackets, a pair of hinge pins, each pin extending outwardly from a respective side of the central longitudinal axis and lying transversely along the rear end of said board body, each shoe bracket having an upper end hingedly mounted on a respective one of said hinge pins and a lower end with a downwardly facing ground engaging brake shoe secured thereon, and a spring means placed on a long bolt passed longitudinally through said shoe bracket and said board body to provide controlled braking tolerance.

2. A roller ski according to claim 1, wherein under said board body a pair of skateblades is fixedly and detachably mountable.

3. A roller ski according to claim 1, wherein under said board body a single skateblade is fixedly and detachably mountable.

4. A roller ski according to claim 1, wherein under said board body a skiplate is fixedly and detachably mountable.

5. A roller ski according to claim 1, wherein a saddle is fixedly and detachably mountable on the upside of said board body.

* * * * *